US006630801B2

(12) United States Patent
Schuurmans

(10) Patent No.: US 6,630,801 B2
(45) Date of Patent: Oct. 7, 2003

(54) METHOD AND APPARATUS FOR SENSING THE COLOR POINT OF AN RGB LED WHITE LUMINARY USING PHOTODIODES

(75) Inventor: Frank Jeroen Pieter Schuurmans, Valkenswaard (NL)

(73) Assignee: Lümileds USA, San Jose, CA (US)

( * ) Notice: Subject to any disclaimer, the term of this patent is extended or adjusted under 35 U.S.C. 154(b) by 0 days.

(21) Appl. No.: 10/083,329

(22) Filed: Oct. 22, 2001

(65) Prior Publication Data

US 2003/0076056 A1 Apr. 24, 2003

(51) Int. Cl.[7] ..... H05B 37/02
(52) U.S. Cl. ..... 315/307; 315/308; 362/800
(58) Field of Search ..... 315/291, 299, 315/300, 301, 302, 307, 308, 363; 362/230, 231, 800; 340/815.45; 345/39, 82, 83; 347/232, 237, 238

(56) References Cited

U.S. PATENT DOCUMENTS 5,724,062 A * 3/1998 Hunter ..... 345/102
6,305,818 B1 * 10/2001 Lebens et al. ..... 362/184
6,394,626 B1 * 5/2002 McColloch ..... 362/251
6,507,159 B2 * 1/2003 Muthu ..... 315/307
6,510,995 B2 * 1/2003 Muthu et al. ..... 235/454

FOREIGN PATENT DOCUMENTS

DE 4232545 A1 2/1994 ..... B60Q/3/00
FR 2755555 A1 5/1998 ..... H04B/10/00
WO WO0247438 6/2002 ..... H05B/33/08

* cited by examiner

*Primary Examiner*—Don Wong
*Assistant Examiner*—Thuy Vinh Tran

(57) ABSTRACT

Method and apparatus for controlling an RBG based LED luminary which measures the output signals of filtered photodiodes and unfiltered photodiodes and correlates these values to chromaticity coordinates for each of the red, green and blue LEDs of the luminary. Forward currents driving the LED luminary are adjusted in accordance with differences between the chromaticity coordinates of each of the red, green and blue LEDs and chromaticity coordinates of a desired mixed color light.

29 Claims, 2 Drawing Sheets

METHOD AND APPARATUS FOR SENSING THE COLOR POINT OF AN RGB LED WHITE LUMINARY USING PHOTODIODES

BACKGROUND OF THE INVENTION

1. Field of the Invention

The present invention relates to RGB based LED luminaries, and more particularly, to a method and apparatus for controlling an RGB based LED luminary, in which the LED luminary is adjusted according to measured differences in wavelengths between the actual wavelengths output by each LED and a desired wavelength of each LED so that the LED luminary generates a desired color and lighting level.

2. Background Information

As well known in the art, red, green and blue (RGB) light emitting diode (LED) based luminaries generate various colors of light which when properly combined produce white light. RGB LED based luminaries are widely used in applications such as, for example, LCD back lighting, commercial-freezer lighting and white light illumination. Illumination by LED based luminaries presents difficult issues because the optical characteristics of individual RGB LEDs vary with temperature, forward current, and aging. In addition, the characteristics of the individual LEDs vary significantly batch-to-batch for the same LED fabrication process and from manufacturer to manufacturer. Therefore, the quality of the light produced by RGB based LED luminaries can vary significantly and the desired color and the required lighting level of the white light cannot be obtained without a suitable feedback system.

One known system for controlling an RGB LED white luminary uses a lumen-feedback temperature-feed-forward control system which controls a white LED luminary so as to provide a constant color light with a fixed lumen output. The temperature-feed-forward control system provides compensation for variations in the color temperature and supplies the reference lumens. The lumen feedback control system regulates each RGB LED lumens to the reference lumens. This type of control system requires the characterization of each type of LED with changes in temperature, which requires a costly factory calibration. In addition, this control system also requires that the LEDs be briefly turned off for light measurements. The turning-off of the LED light sources introduces flicker to the light source. Therefore the power supplies must have a relatively fast response time. In addition, a PWM (pulse-width-modulation) driving method is required to overcome the LED variations with forward current. With the PWM control, the implementation becomes complex and, in addition, the LEDs are not utilized to their full capacity.

Another known prior art system compares the feedback tristimulus values (x,y,L) of the mixed output light of the RGB based LED luminary with tristimulus values representative of the desired light, and adjusts the forward currents of the LED luminary in such a way that the difference in tristimulas values is decreased to zero. The system control includes a feedback unit including photodiodes which generate the feedback tristimulus values of the LED-luminary, and a controller for acquiring a difference between the feedback tristimulus values and the desired reference tristimulus values. The system generates control voltages which adjust the forward currents of the LED luminary so that the difference in tristimulus values is decreased to zero.

The tristimulus values under comparison may be either under the CIE 1931 tristimulus system or under a new RGB calorimetric system. In either case, the control of the luminary tracks the reference tristimulus values. Thus, under a steady-state where the feedback tristimulus values follow the desired reference tristimulus values, the light produced by the LED luminary has the desired target color temperature and lumen output, which are regulated to the target values regardless of variations in junction temperature, forward current and aging of the LEDs.

The efficiency and accuracy of these prior art methods depend on their ability to sense both the CIE chromaticity coordinates as well as the luminous intensity L of the white color point. There exists a need in the art for a system and method of controlling RGB based LED luminaries which is not dependent upon sensing CIE chromaticity coordinates as well as the luminous intensity L of the white color point.

OBJECTS AND SUMMARY OF THE INVENTION

It is an object of the present invention to overcome disadvantages of the prior art systems and methods of controlling an RGB based LED luminary.

In accordance with one form of the present invention, a method of controlling an LED luminary including red, green and blue (RGB) light emitting diodes (LEDs) driven by forward currents to produce a mixed color light includes the steps of:

- measuring an output signal of a filtered photodiode for each of the red, green and blue LEDs of the LED luminary;
- measuring an output signal of an unfiltered photodiode for each of the red, green and blue LEDs of the LED luminary;
- calculating a photodiode output signal ratio by dividing the output signal for the filtered photodiode with the output signal of the unfiltered photodiode for each of the red, green and blue LEDs;
- utilizing the photodiode output signal ratio to determine the chromaticity coordinates for each of the red, green and blue LEDs; and
- adjusting the forward currents for each of the red, green and blue LEDs to produce a desired color light.

In accordance with another form of the present invention, a control system for an LED luminary including red, green and blue (RGB) light emitting diodes (LEDs) driven by forward currents to produce a mixed color-light includes:

- a feedback unit which generates feedback values representative of the mixed color light produced by said LED luminary, said feedback values corresponding to output signals of a photodiode; and
- a controller which acquires a difference between said feedback values and reference values representative of a desired mixed color light, said controller adjusting said forward currents in accordance with said difference.

These and other objects, features and advantages of the present invention will become apparent from the following detailed description of illustrative embodiments, which is to be read in connection with the accompanying drawings.

DETAILED DESCRIPTION OF THE PREFERRED EMBODIMENT

Figure 1:
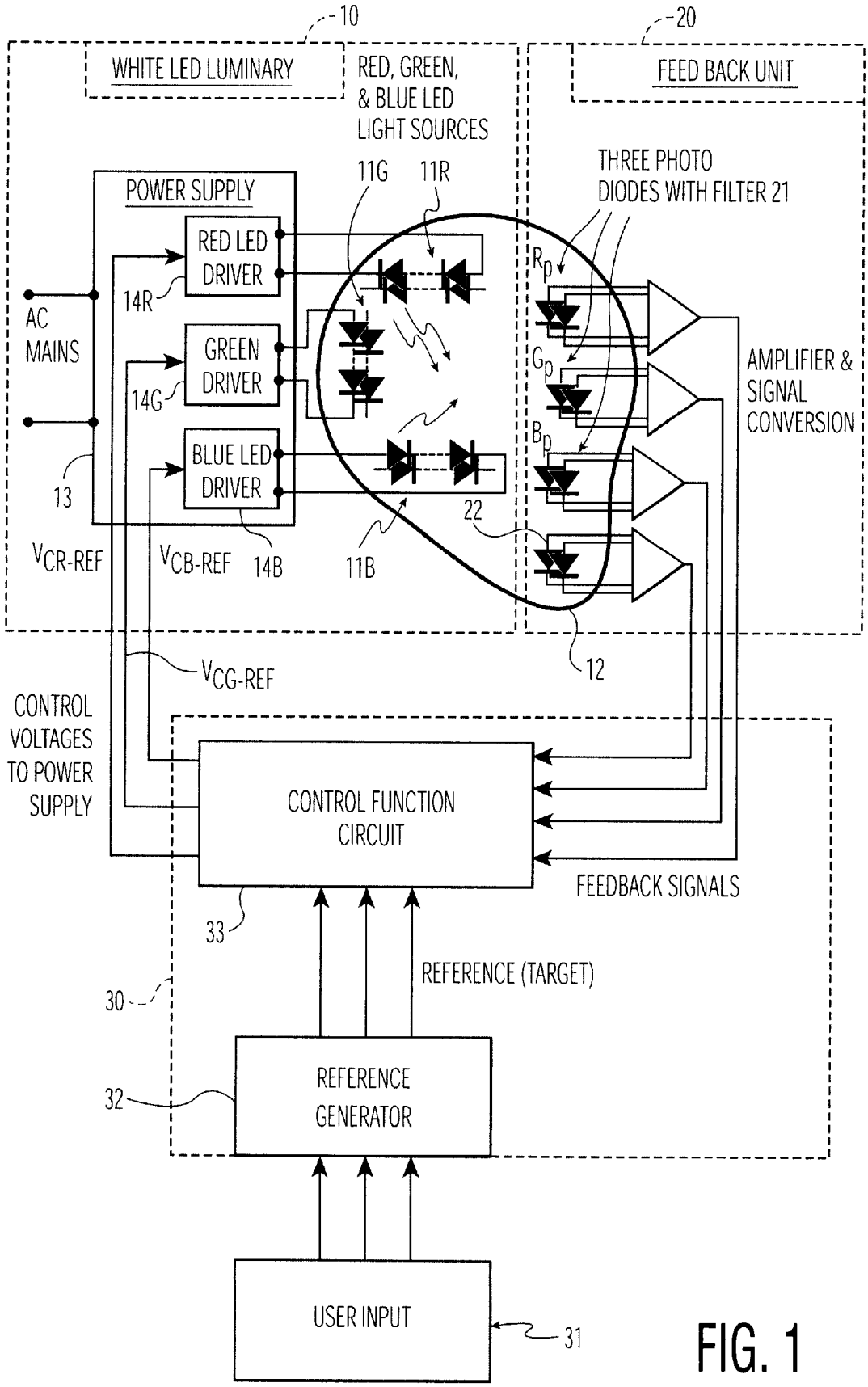
FIG. 1 is a schematic diagram of a RGB based LED luminary including the sensing apparatus in accordance with the present invention.

RGB LEDs can be used to make white light. This is not new. The same principle is used in fluorescent tube lighting and TVs, both of which are based on phosphor emission instead of illumination of LEDs. In the field of colorimetry, colors are quantified by chromaticity coordinates, of which the most widely used are the CIE (Commission Internationale de l'Eclairage) 1931 (x,y,L) chromaticity coordinates. Here the combination of x and y define the color and L defines the brightness, i.e. luminosity, of the light. This system is based on the response of the eye of the average observer and is the internationally accepted standard.

The consistent generation of good quality white light is primarily based on making lamps with near identical chromaticity coordinates. In other words, for a lamp manufacturer it is important that every lamp of a specific kind be visually identical for the user/observer. In the case of fluorescent tube lighting this is achieved by mixing the different colored phosphor powders in appropriate proportions. This is a simple procedure and achieves near identical fluorescent tubes. For the manufacture of RGB LED luminaries this is not as simple. In the first instance, it would be said that one needs to figure out only once what the appropriate driving currents of the separate RGB LEDs need to be in order to achieve the desired color light (white point). This would be true if all LEDs of a particular color are identical. However, this is not the case. In the manufacture of LEDs, significant differences in physical properties and performance of each LED are unavoidable. For example, the efficiency of various green LEDs from a manufacturing lot can vary significantly, sometimes by at least a factor of two. Using such LEDs without taking into account the variability in performance would lead to inconsistent product performance due to the large variation in white point (from purple-white light to green-white light) between the various lamps in which these LEDs are used. This problem needs to be solved.

A common solution to this problem is achieved by binning LEDs. That is measuring the relevant physical properties of every LED, labeling them, and making products with selected combinations of LEDs. Besides the fact that this method is a logistical nightmare (i.e., it is very expensive), this approach will not solve all problems. After fabrication of the lamp, the properties of LEDs change (this is called ageing of LEDs) which leads to variation in the color point after some time. The only way to ensure a consistent color point from manufacture through the usable life of the lamp is to constantly measure the color point for the entire lifetime of the lamp, and adjust the driving currents (or pulse width modulation duty cycles) correspondingly to achieve and maintain the desired white point. The present invention discloses one method of measuring and controlling the color point of an RGB LED based luminary, using signals from filtered and unfiltered photodiodes.

Referring now to FIG. 1 of the drawings, the apparatus for sensing the color point of an RGB LED white luminary using three edge filtered photodiodes in combination with an unfiltered photodiode is shown. The system includes a white LED luminary 10, a feedback unit 20 and a controller 30. As an exemplary embodiment, a white LED luminary 10 is described herein, but it shall be appreciated that the present invention is applicable to any other color LED luminary.

The white LED luminary 10 includes red, green and blue (RGB) LED light sources 11R, 11G and 11B, optical assembly and heat sink 12, and power supply 13 with three independent red, green and blue drivers 14R, 14G and 14B. Each LED light source is made of a plurality of LEDs with similar electrical and optical characteristics, which are connected in proper series and parallel combinations to make a light source as known in the art. The LEDs are mounted on the heat sink and their arrangement in the heat sink is subject to the application of the white LED luminary 10 such as back lighting and white light illumination for freezers. Depending on the application, proper optics is used to mix the light optics of the RGB LED light sources 11R, 11G, 11B to produce the white light.

The LED light sources 11R, 11G, 11B are driven by a power supply 13 which includes three independent drivers 14R, 14G, 14B for the RGB LED light sources. The power supply and drivers for the LED light sources are based on suitable AC-to-DC, DC/DC converter topologies. The RGB LED drivers receive LED forward current reference signals in the form of the control voltages $V_{CR\text{-}REF}$ $V_{CG\text{-}REF}$ and $V_{CB\text{-}REF}$ from the controller 30 and supply the necessary control voltages and/or forward currents to the RGB LED light sources. The LED drivers contain current feedback and suitable current controlling systems, which make the LED forward currents follow their references. Here the control voltages $V_{CR\text{-}REF}$, $V_{CG\text{-}REF}$ and $V_{CV\text{-}REF}$ are the references to the current controlling systems for the respective forward currents that drive the LED light sources.

In the preferred embodiment the feedback unit 20 includes three filtered photodiodes 21R, 21G, 21B and an unfiltered photodiode 22. The feedback unit includes the necessary amplifier and signal conversion circuits to convert the output signals of the filtered and unfiltered photodiodes to an electrical signal that can be used by the controller 30. The filtered and unfiltered photodiodes are mounted in a suitable place inside the optical assembly 12 in such a way that the photodiodes receive sufficient mixed light from the LED light sources 1R, 11G, 11B. Therefore, the corresponding photocurrents are higher than the noise levels and can be distinguished from any noise (other light). The photodiodes are also shielded such that stray and ambient light are not measured by the photodiodes. The details of the placement of the photodiodes are specific to the application. The amplifier and signal conversion circuits convert the photocurrents to voltage signals with proper amplifications.

The controller 30 includes a user interface 31, a reference generator 32 and a control function circuit 33 for implementing control functions. The controller 30 can be in either analog or digital form. In the preferred embodiment the controller is in digital form using a.microprocessor and/or microcontroller. The user interface 31 obtains the desired white color point and the lumen output of the light desired by the user and converts these inputs into appropriate electrical signals, which are provided to the reference generator 32 which correlates the electrical signals to chromaticity coordinates of the desired white color print. The chromaticity coordinates are provided to controller 33 along the feedback signals from the feedback unit 20 as explained below.

The controller 30 contains the necessary control function unit 33 to track and control the light produced by the white LED luminary 10. The output of the user interface 31, which provides the desired color and lumen output for the white light are provided to the reference generator 32, which, based on the user input signals, derives the necessary chromaticity coordinates which are provided to the control function unit 33. The feedback signals for the control function unit 33 are derived from the output of the feedback unit 20. The feedback signals are provided to the control function unit which determines a difference between the chromaticity coordinates of the RGB LEDs of the white LED luminary (based on the output of the photodiodes) and the chromaticity coordinates of the desired color light provided by the reference generator. The controller provides the necessary control voltages $V_{CR-REF}$, $V_{CG-REF}$, $V_{CB-REF}$ for the power supply 13 and LED drivers 14R, 14G, 14B based on the analysis of the feedback signals (explained below) which in turn changes the forward current of the LED light sources to provide the desired color light. The feedback preferably continues for the life of the luminary to provide a consistent color point for the life of the luminary.

The method of controlling an LED luminary including red, green and blue (RGB) light emitting diodes (LEDs) driven by forward current to produce a color light will now be described. It should be mentioned that initially the chromaticity coordinates for a plurality of desired color points must be provided to the reference generator so that when a user inputs a desired color light, the corresponding coordinates can be supplied to the control function unit. Moreover, a LUT for each red, green and blue LED of the type employed in the luminary must be stored, preferably in a memory internal to the controller unit, to correlate the measured feedback signals provided by the feedback unit 20 to estimate chromaticity coordinates for the red, green and blue LEDs being used in the luminary.

In a preferred embodiment one look-up table is generated for each type of LED (that is, one lookup table for the red LED, one lookup table for the green LED and one lookup table for the blue LED). The lookup table is generated by measuring the output signal (F) of an edge filtered photodiode and the output signal (A) of an unfiltered photodiode for each group of LED. In addition, the chromaticity coordinates x and y, and the luminous efficacy E, which define the characteristics of the LED are also measured. The luminous efficacy is obtained by dividing the measured luminosity (obtained from a spectrometer) by the unfiltered photodiode output signal (i.e., E=L/A). Based on the measurements for a plurality of LEDs, a relationship is determined between the ratio (F/A) of the output signal (F) of the filtered photodiode to the output signal (A) of the unfiltered photodiode, the chromaticity coordinates x and y, and the luminous efficacy E.

After the lookup tables are generated, they are stored in memory for access by the control function circuit 33. If the lookup tables have been previously generated by the manufacture of the LEDs, the information can be downloaded into the system memory.

Figure 2:
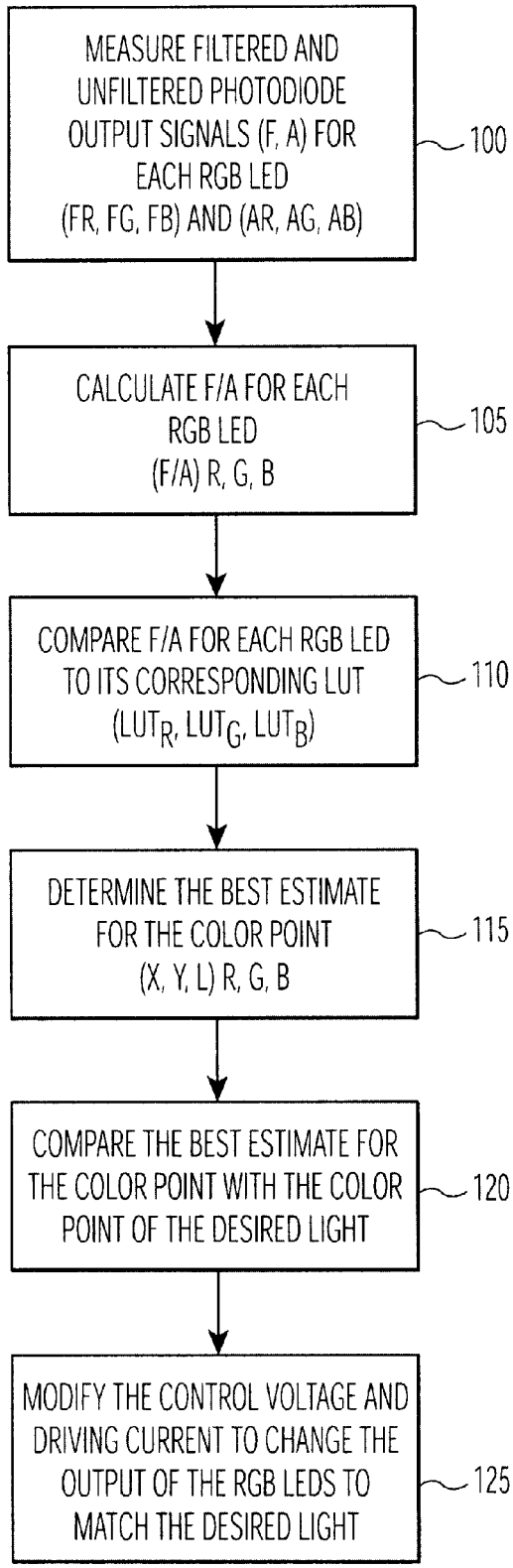
FIG. 2 is a flow chart illustrating the control method in accordance with the present invention.

Referring to FIG. 2, the method of controlling an LED luminary is shown. The method includes measuring the filtered and unfiltered photodiode output signals after the white LED luminary is operated (Step 100). As mentioned previously, in the preferred embodiment three separate filtered photodiodes used. One filtered photodiode 21R measures the output of the red LEDs, one filtered photodiode 21G measures the output of the green LEDs, and one filtered photodiode 21B measures the output of the blue LEDs. The apparatus also includes one unfiltered photodiode which is used to measure the unfiltered output of the red, green and blue LEDs. The unfiltered photodiode output signal of the red, green and blue LEDs is accomplished in the preferred embodiment with a single photodiode by alternatively turning off two of the three LEDs so that only the output of the one currently operating LED is measured. That is, to measure the unfiltered photodiode output signal for the red LED, the green and blue LEDs are momentarily turned off, to measure the unfiltered photodiode output signal for the green LED, the red and blue LEDs are turned off, and to measure the unfiltered photodiode output signal for the blue LED, the red and green LEDs are turned off.

The output signals of the filtered (F) and unfiltered (A) photodiodes are provided to the control function circuit 33 which generates a photodiode output signal ratio (F/A) by dividing the output signal for the filtered photodiode with the output signal (A) of the unfiltered photodiode for each of the red, green and blue LEDs (Step 105). The photodiode output signal ratio for each of the red, green and blue LEDs is then compared to the corresponding red, green and blue look-up tables stored in the control function circuit (Step 110). From the look-up table, and based upon the photodiode output signal ratio for the red, green and blue LEDs, the chromaticity coordinates ($X_{LUT}$, $Y_{LUT}$) and the luminous efficacy ($E_{LUT}$) for the red, green and blue LEDs is obtained.

Thereafter, the best estimate for the actual color point (x, y and L) of the red, green and blue LEDs of the luminary are obtained (Step 115). The best estimate for the x and y chromaticity coordinates correspond to the x and y coordinates from the corresponding lookup table. The luminosity of each of the red, green and blue LEDs is calculated by multiplying the luminous efficacy ($E_{LUT}$) by the measured unfiltered photodiode output signal (A) obtained from the feedback unit 20. The estimate of the color point of the white LED luminary is then compared to see if it is different from that of the desired color point input by the user through user interface 31 (Step 120). If a difference exists, and based on the best estimate of the current color point for the red, green and blue LEDs of the white LED luminary, the output of each of the LEDs is modified to generate the desired white color point (the color point provided by the user through user interface 31) (Step 125). That is, based on the estimated color points, the controller generates the control voltages and forward currents (using standard color mixing) which are provided to the LED drivers to modify the output of the red, green and blue LEDs to provide the desired white light input by the user.

The present invention is advantageous in that the method does not require a factory calibration to obtain the temperature related characteristic of the LEDs. In addition, it overcomes the batch-to-batch variations in the LEDs, which can lead to significant cost reduction due to the use of any LED in a batch.

Although illustrative embodiments of the present invention have been described herein with reference to the accompanying drawings, it is to be understood that the invention is not limited to these precise embodiments, and that various other changes and modifications may be effected therein by one of ordinary skill in the art without departing from the scope or spirit of the invention. For example, instead of using three filtered photodiodes and one unfiltered photodiode, one photodiode could be used with a rotating color wheel to generate the necessary filtered and unfiltered photodiode output signals. Moreover, instead of one unfiltered photodiode, three separate unfiltered photodiodes could be employed, respectively corresponding to the RGB LEDs.

What is claimed:

1. A method of controlling an LED luminary including red, green and blue (RGB) light emitting diodes (LEDs) driven by forward currents to produce a mixed color light comprising the steps of:

measuring an output signal of a filtered photodiode for each of the red, green and blue LEDs of the LED luminary;

measuring an output signal of an unfiltered photodiode for each of the red, green and blue LEDs of the LED luminary;

calculating a photodiode output signal ratio by dividing the output signal for the filtered photodiode with the output signal of the unfiltered photodiode for each of the red, green and blue LEDs;

utilizing the photodiode output signal ratio to determine chromaticity coordinates for each of the red, green and blue LEDs; and adjusting the forward currents for each of the red, green and blue LEDs to produce a desired color light.

2. The method of controlling an LED luminary according to claim 1, wherein the utilizing step comprises a step of:

accessing a look-up table (LUT) which includes a correlation between the photodiode output signal ratio and chromaticity coordinates for each of the red, green and blue LEDs.

3. The method of controlling an LED luminary according to claim 2 further comprising a step of generating a LUT for each of the red, green and blue LEDs by:

calculating a photodiode output signal ratio for each of a plurality of red, green and blue LEDs;

measuring chromaticity coordinates for each of the plurality of red, green and blue LEDs; and determining a relationship between the calculated photodiode output signal ratio and the chromaticity coordinates for each of the red, green and blue LEDs.

4. The method of controlling an LED luminary according to claim 1 wherein the chromaticity coordinates correspond to a CIE 1931 chromaticity coordinate system.

5. The method of controlling an LED luminary according to claim 1 wherein the chromaticity coordinates correspond to a new RGB colorimetric system.

6. The method of controlling an LED luminary according to claim 1 further comprising the step of:

selecting said desired color light.

7. The method of controlling an LED luminary according to claim 6 wherein said step of selecting said desired color light includes selecting a desired color point of the LED luminary.

8. The method of controlling an LED luminary according to claim 7 further comprising the steps of:

pre-storing a plurality of desired color points of the LED luminary in a memory; and selecting one of the plurality of desired color points as the desired color light.

9. The method of controlling an LED luminary according to claim 1 wherein said adjusting step comprises the steps of:

generating control voltages for each of the red, green and blue LEDs based on said chromaticity coordinates for each of the red, green and blue LEDs and chromaticity coordinates for the desired color light; and applying said control voltages to LED drivers for each of the red, green and blue LEDs so as to adjust forward currents for each of the red, green and blue LEDs to produce the desired color light.

10. The method of controlling an LED luminary according to claim 1 wherein said steps are implemented by analog circuitry.

11. The method of controlling an LED luminary according to claim 1 wherein said steps are implemented by digital circuitry.

12. The method of controlling an LED luminary according to claim 1 wherein the steps of measuring the output signal of a filtered photodiode and measuring the output signal of an unfiltered photodiode are carried out in predetermined time intervals.

13. A control system for an LED luminary including red, green and blue (RGB) light emitting diodes (LEDs) driven by forward currents to produce a mixed color light, comprising:

a feedback unit which generates feedback values representative of the mixed color light produced by said LED luminary, said feedback values corresponding to output signals of a photodiode; and a controller operatively coupled to said feedback unit which determines a difference between said feedback values and reference values representative of a desired mixed color light, said controller adjusting at least one of control voltages and forward currents in accordance with said difference.

14. The control system for an LED luminary according to claim 13 wherein said feedback unit comprises a filtered photodiode and an unfiltered photodiode.

15. The control system for an LED luminary according to claim 14 wherein said filtered photodiode corresponds to an edge-filtered photodiode and wherein the edge filtered photodiode comprises an optical colored glass filter which transmits long wavelengths of light and absorbs short wavelengths of light and having a small wavelength transition region centered around a cut-off wavelength.

16. The control system for an LED luminary according to claim 15 wherein cut-off wavelengths for each of the filtered photodiodes for said red, green and blue LEDs are 610 nm, 530 nm and 470 nm respectively.

17. The control system for an LED luminary according to claim 13 wherein said feedback unit further comprises an amplifier and signal conversion circuitry for converting output photocurrents of said photodiode to voltage signals.

18. The control system for an LED luminary according to claim 13 wherein said feedback unit further comprises means for providing said feedback values to said controller.

19. The control system for an LED luminary according to claim 13 further comprising a user interface operatively coupled to said controller for a user to select said desired mixed color light.

20. The control system for an LED luminary according to claim 19 further comprising a memory operatively coupled to said controller for storing and providing to said controller reference values representative of said desired mixed color light.

21. The control system for an LED luminary according to claim 13 wherein said reference values correspond to chromaticity coordinates of the CIE 1931 chromaticity coordinate system.

22. The control system for an LED luminary according to claim 13 wherein said reference values correspond to chromaticity coordinates in a new RGB colorimetric system.

23. The control system for an LED luminary according to claim 13 further comprising a voltage generator operatively coupled to said controller which generates a control voltage in accordance to said difference between said feedback values and said reference values, said controller applying said control voltage to LED drivers for each of the red, green and blue LEDs of said LED luminary so as to adjust forward currents for each of the red, green, blue LEDs to produce the desired color light.

24. The control system for an LED luminary according to claim 13 wherein said controller comprises analog circuitry.

25. The control system for an LED luminary according to claim 13 wherein said controller comprises digital circuitry.

26. The control system for an LED luminary according to claim 13 further comprising a memory operatively coupled to the controller for pre-storing a plurality of desired mixed color lights that a user may select.

27. The control system for an LED luminary according to claim 13 wherein said feedback unit comprises further comprising first, second and third filtered photodiodes respectively corresponding to said red, green and blue LEDs, and an unfiltered photodiode.

28. The control system for an LED luminary according to claim 27 wherein said feedback unit measures an output signal of said first, second and third filtered photodiodes and an output of said unfiltered photodiode for each of said red, green and blue LEDs; and said controller calculates a photodiode output signal ratio by dividing filtered photodiode output signals for said red, green and blue LEDs with unfiltered photodiode output signals for said red, green and blue LEDs respectively, utilizes the photodiode output signal ratio to determine chromaticity coordinates for each of the red, green and blue LEDs, and adjusts forward currents for each of the red, green and blue LEDs to produce the desired mixed color light.

29. The control system for an LED luminary according to claim 28 wherein said controller determines the chromaticity coordinates for each of the red, green and blue LEDs by accessing a look-up table which includes a relationship between the photodiode output signal ratio and the chromaticity coordinates for each of the red, green and blue LEDs.

* * * * *